United States Patent [19]

DiProspero

[11] 4,010,565

[45] Mar. 8, 1977

[54] GUN CLEANING AND SAFETY DEVICE

[76] Inventor: Peter DiProspero, 814 W. 25th St., Erie, Pa. 16502

[22] Filed: June 17, 1976

[21] Appl. No.: 697,137

[52] U.S. Cl. ..... 42/1 R; 42/1 N

[51] Int. Cl.[2] ..... F41C 31/00

[58] Field of Search ..... 42/1 N, 1 MH, 1 LP, 42/1 R, 90; 15/104.16

[56] References Cited

UNITED STATES PATENTS

| | | | |
|---|---|---|---|
| 2,763,081 | 9/1956 | Huckabee | 42/1 N |
| 3,137,957 | 6/1964 | Ingalls | 42/1 N |
| 3,710,411 | 1/1973 | Murguiondo | 42/1 MH |
| 3,813,802 | 6/1974 | DiProspero | 42/1 R |

*Primary Examiner*—Charles T. Jordan

[57] ABSTRACT

A gun cleaning kit made up of a tube of relatively flexible thermoplastic material having a cleaning patch tip with a slot in the first end, the second end being received in a cylindrical member having a reduced size cylindrical end for fitting into a cylindrical cup containing cleaning materials.

4 Claims, 7 Drawing Figures

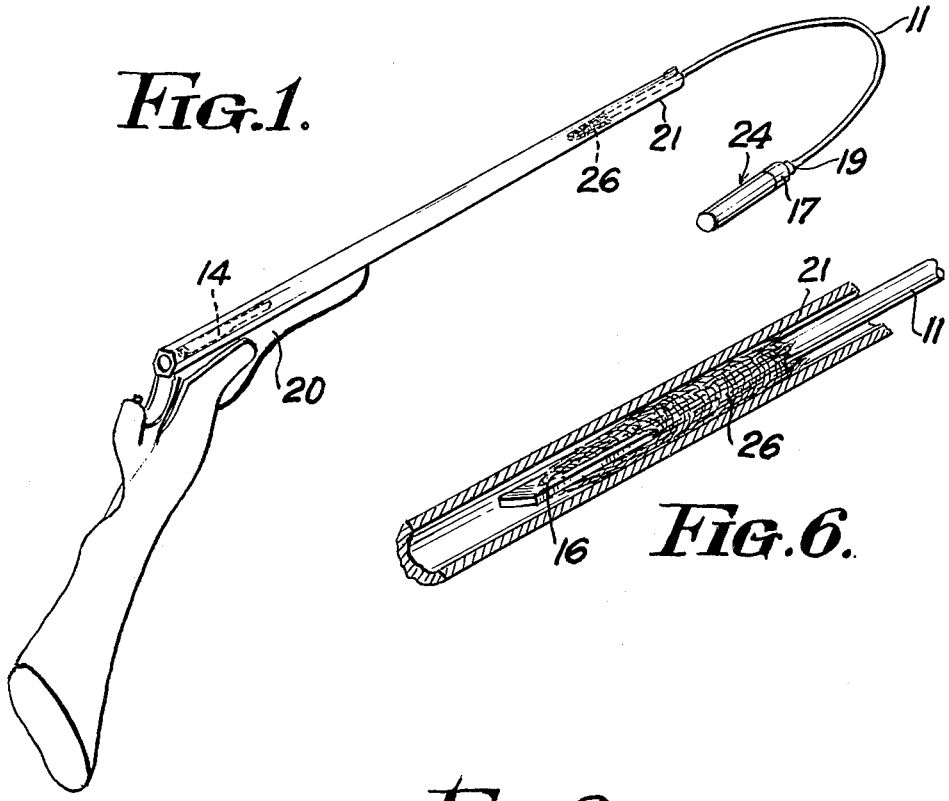
FIG. 1.
FIG. 6.
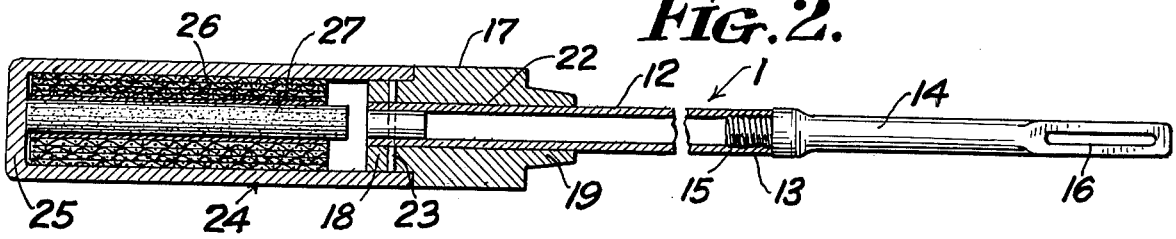
FIG. 2.
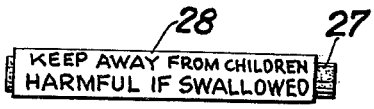
FIG. 3.
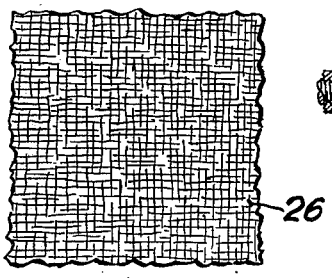
FIG. 4.
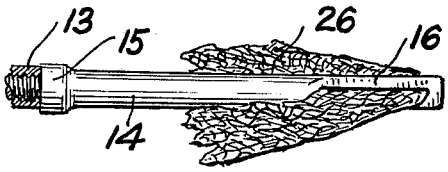
FIG. 5.
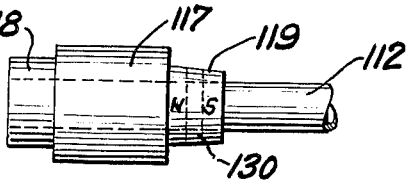
FIG. 7.

GUN CLEANING AND SAFETY DEVICE

OBJECTS OF THE INVENTION

It is an object of the invention to provide an improved cleaning kit.

Another object of the invention is to provide a cleaning kit for a gun that is simple in construction, economical and simple and efficient to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions, and minor details of construction without departing from the spirit or sacrificing any of the advantages of the invention.

GENERAL DESCRIPTION OF THE DRAWINGS

FIG. 1 is a view of a gun having the cleaning tube extended into the barrel thereof.

FIG. 2 is an enlarged, partial, cross-sectional view of the cleaning kit according to the invention.

FIG. 3 is an enlarged side view of the small plastic tube of oil.

FIG. 4 is a view of a fabric cleaning patch.

FIG. 5 is an enlarged view of a tip with a cleaning patch therein.

FIG. 6 is a view of the cleaning patch insidethegun barrel

FIG.7is aviewofanother embodiment of the invention.

DETAILED DESCRIPTION OF THE DRAWINGS

Now, with more particular reference to the drawings, the cleaning kit and safety device indicated generally at 1 includes a rod 11 and cleaning material tube 24. The rod 11 is made of a tubular material such as thermoplastic or the like, eg., nylon, polyethylene, vinyl or the like. Tube 11 has a first end 12 and a second end 13 and the tip 14 has reduced size threaded end 15 that is received in the end 13 of the tube 11. The tube 11. The tip 14 has a slot 16 which may receive the cleaning patch 25. The second end 12 of the tube is received in the hole 22 in the cylindrical member 17. A red danger notice will be located on second end 12. The cylindrical member 17 has a reduced size tapered end 19 which may be snugly fitted and frictionally received in the muzzle of the gun and the pin 23 extends through both cylindrical member and rod and locks the end 12 of the tube in the cylindrical member 17.

The second reduced size end 18 frictionally receives the open end of the container 24. Container 24 is cylindrical in shape and has a closed end 25 and receives the lubricant stick 27 with the cloth patch 26 wrapped around it. The lubricant stick 27 may have a paper cover 28 wrapped around it with a suitable caution thereon.

When the cleaning rod 11 is inserted in the gun barrel the tube 11 will be of sufficient length that the tip 14 extends into the chamber of the gun, thereby preventing a round from being inserted in the the chamber thereby preventing the loading of the gun when the end 19 is frictionally received in the muzzle of the gun.

In the embodiment of the invention shown in FIG. 7, a cylindrical member 117, similar to the member 17 in FIG. 2, is shown. Member 117 has a reduced size end 119 that can enter the muzzle of a gun of the proper caliber and the tube 112 forming the cleaning rod is received in the hollow in the cylinder 117. The reduced size end 118 frictionally receives a hollow cup, such as cup 24 in FIG. 2. A permanent magnet 130 is fitted into a cylindrical shaped opening in the reduced size end 119 and this permanent magnet holds the cleaning rod in the gun barrel when inserted therein. The lubricant 27 may be a solid lubricant having a wax like consistency which might be harmful to a child if swallowed.

The foregoing specification sets forth the invention in its preferred practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A cleaning kit and rod comprising a tube made of a thermoplastic material having a first end and a second end, a tip on said first end having a reduced size end received in the first end of said tube and a flattened end on the second end of said tip with a slot for receiving a cleaning patch, said reduced size end being received in said first end of said tube, a cylinder member having a reduced size cylindrical end and a tapered end, said tapered end being of a suitable size to fit into the muzzle of a gun of a size for which said kit is adapted, a hole through said cylinder member, said second end of said tube extending through said hole and means holding said second end of said tube in said hole, a hollow, cylindrical cup closed at one end and adapted to fit over said cylindrical end of said cylindrical member for containing cleaning material.

2. The cleaning kit recited in claim 1 wherein said means holding said tube in said cylinder comprises a pin extending through said cylinder and through said tube.

3. The cleaning kit recited in claim 1 wherein said means holding said cylinder to said gun barrel comprises a tapered, frictional fit between said reduced size member and said gun barrel.

4. The cleaing kit recited in claim 1 wherein said means holding said kit to said gun barrel compriese a permanent magnet disposed in said cylinder.

* * * * *